United States Patent [19]

Gembarosky et al.

[11] Patent Number: 4,919,465

[45] Date of Patent: Apr. 24, 1990

[54] PROTECTOR FOR "C" HOOKS

[75] Inventors: Michael P. Gembarosky, Lower Burrell; Gary S. Clark, Pittsburgh; Howard E. Baybrook, New Kensington; Arthur E. Trudgeon, Apollo, all of Pa.

[73] Assignee: Allegheny Ludlum Corporation, Pittsburgh, Pa.

[21] Appl. No.: 266,713

[22] Filed: Nov. 3, 1988

[51] Int. Cl.[5] ..... B66C 1/54

[52] U.S. Cl. ..... 294/67.2; 267/140

[58] Field of Search ..... 294/67.2, 67.21, 67.22, 294/82.1, 103.2; 267/140, 153

[56] References Cited

U.S. PATENT DOCUMENTS

| | | | |
|---|---|---|---|
| 1,836,576 | 12/1931 | Chalmers | 294/82.1 |
| 1,857,091 | 5/1932 | Von Der Horst | 294/82.1 X |
| 3,045,958 | 7/1962 | Mackie | 294/82.1 X |
| 4,641,876 | 2/1987 | Kiser et al. | 294/103.2 X |
| 4,717,188 | 1/1988 | Johnston | 294/67.2 |
| 4,784,419 | 11/1988 | Jensen et al. | 294/67.2 |
| 4,810,016 | 3/1989 | Greenhow | 294/67.21 |

FOREIGN PATENT DOCUMENTS

| | | | |
|---|---|---|---|
| 2304145 | 8/1974 | Fed. Rep. of Germany | 294/82.1 |
| 636173 | 12/1978 | U.S.S.R. | 294/82.1 |

*Primary Examiner*—Margaret A. Focarino
*Assistant Examiner*—F. Hamlin Williams, Jr.
*Attorney, Agent, or Firm*—Patrick J. Viccaro

[57] ABSTRACT

Protector for "C" hooks used to elevate and transport coils of metallic material and the like wherein urethane rubber is vulcanized to the hook in strategic areas which contact or have the potential of contacting the sides of a coil of strip material. A replaceable insert is used in the high-wear area of the forward end of the lower horizontal leg of the hook.

10 Claims, 2 Drawing Sheets

PROTECTOR FOR "C" HOOKS

BACKGROUND OF THE INVENTION

1. Field of the Invention

While not limited thereto, the present invention is particularly adapted for use with a so-called "C" hook used in the steel industry to lift and transport steel coils. The hook is usually made from steel plate and, as the name implies, is generally C-shaped in configuration, having a vertical portion with upper and lower horizontal legs projecting therefrom when the hook is suspended from an overhead crane. The horizontal upper leg has a clevis attached to the hook at its approximate center or balance point such that a crane hook may be inserted into the clevis for lifting. The bottom leg of the hook is inserted into the central opening of a steel coil such that when the hook is lifted by the crane, it will carry with it the coil which rests on the lower leg.

2. Description of the Prior Art

A "C" hook is typically formed from about three-inch steel plate and, consequently, is quite heavy. In the past, it was recognized that the forward face of the vertical portion of the hook can slam against the side of the coil while the lower horizontal leg is being introduced into the central opening of the coil. The rear face of the vertical portion can also slam against coils in storage. This can cause damage to the edges of the strip material, even though the edges might be perfectly aligned.

In the past, the edges or faces of the vertical portion of such a "C" hook have been provided with a cushioning material, such as molded urethane, to prevent damage to a steel coil, either carried on the hook or in storage. Most of these cushioning pads are removably secured to the vertical portion of the hook by bolts or by steel straps as exemplified, for example, in U.S Pat. No. 4,717,188 and co-pending application Ser. No. 163,447, Filed Mar. 3, 1988, both assigned to the Assignee of the present application. Prior art systems of this type, however, do not provide cushioning material at the forward ends of the upper and lower horizontal legs with the result that damage can occur to the coil if the forward end of the horizontal leg slams into the side of the coil.

SUMMARY OF THE PRESENT INVENTION

In accordance with the present invention, urethane rubber is vulcanized to crane hooks in strategic areas which contact or have the potential of contacting sides of a coil of strip material, usually steel strip material. Additionally, a replaceable insert is used in the high wear area of the forward end of the lower horizontal leg of the hook.

Specifically, a protection system is provided for a crane "C" hook to prevent impact damage to a coil of strip material lifted by a hook wherein shock absorbing material is secured to both the inner and outer faces of the vertical leg of the hook. A receptacle is formed or machined in the forward end of the lower horizontal leg of the "C" hook; while a protruding plug of shock absorbing material, such as semi-rigid urethane, is inserted into the receptacle such that if the forward end of the lower horizontal leg engages the side of a coil, the shock absorbing material will prevent damage to the same. The forward end of the upper horizontal leg of the hook is provided with a counterweight. Shock absorbing material is vulcanized to the forward, bottom and side faces of the counterweight, again to prevent damage to the side of a coil of strip material.

BRIEF DESCRIPTION OF THE DRAWINGS

The above and other objects and features of the invention will become apparent from the following detailed description, taken in connection with the accompanying drawings which form a part of this specification and in which.

DESCRIPTION OF THE PREFERRED EMBODIMENTS

Figure 1:
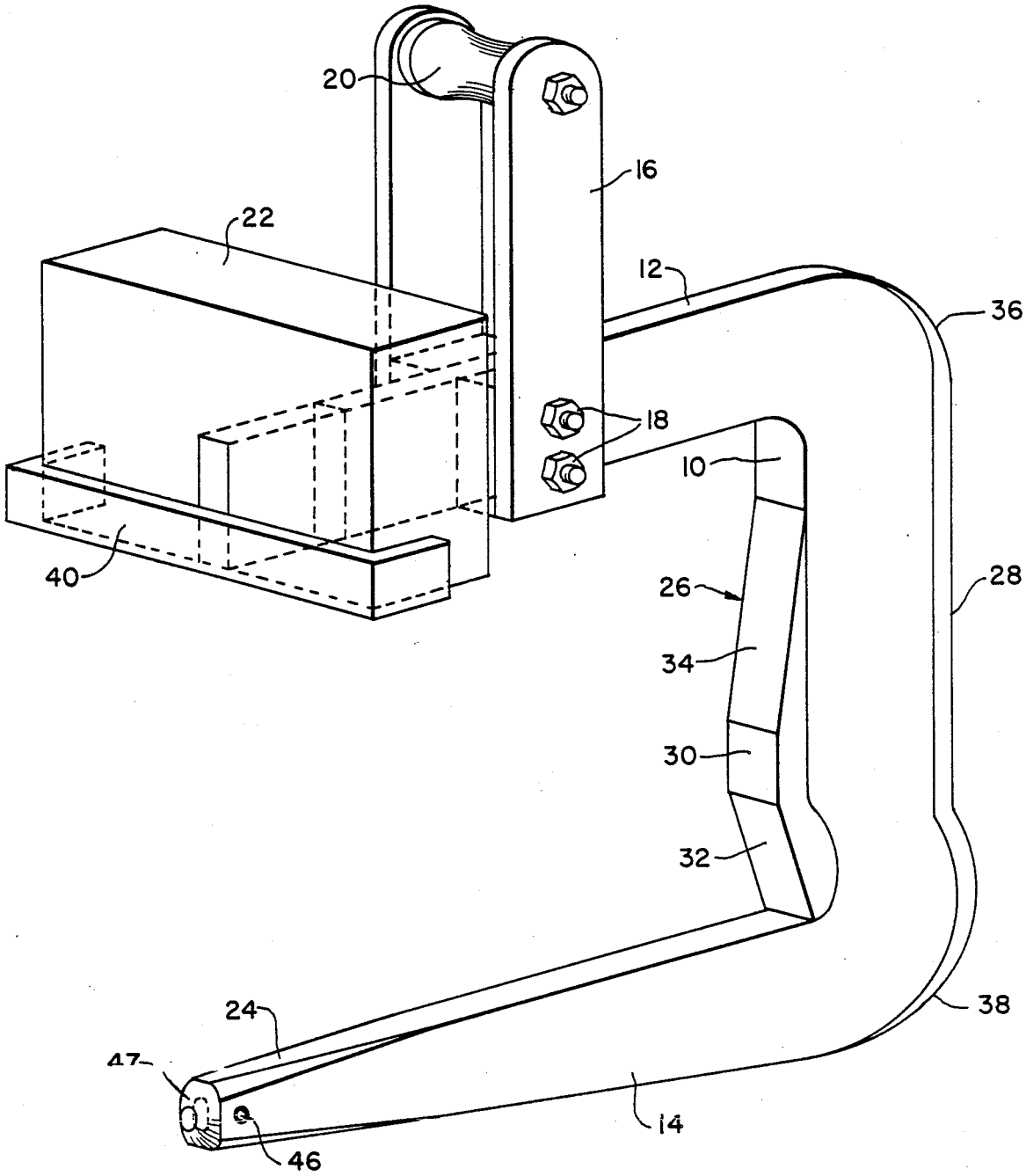
FIG. 1 is a perspective view of a typical "C" hook utilizing the protective system of the invention.

With reference now to the drawings, and particularly to FIG. 1, a typical "C" hook is shown and comprises a vertical portion 10 having a horizontal upper leg 12 and lower horizontal leg 14 projecting therefrom. A clevis 16 is secured to the upper leg 12 by means of bolts 18 or other fastening means and is provided with an upper hinge pin 20 which is engaged with an overhead crane hook, not shown. As was mentioned above, the hook is typically formed from about three-inch steel plate and is quite heavy. The lower horizontal leg 14 is inserted into the central, circular opening of a coil of strip material, the arrangement being such that as the lower leg 14 is moved into the central opening of the coil and lifted upwardly by the overhead crane, the upper surface of the leg 14 will engage the periphery of the central opening in the coil to lift it also. When the coil is deposited in another location within the mill, the foregoing process is reversed to remove the lower leg 14 from the central opening of the coil.

As was explained above, it often happens that the vertical portion 10 of the "C" hook slams into the side of coiled strip material, thereby causing damage to the edges of the strip even though they might be perfectly aligned. Similarly, a counterweight 22 at the forward end of the upper leg 12 or the forward end 24 of the lower leg 14 can slam into the side of a coil.

In accordance with the present invention, molded, semi-rigid plastic material is secured to the inner and outer edges of the vertical portion 10. Preferably, a molded pad 26 is vulcanized to the inner edge or surface of the vertical portion 10; while a strip of similar molded plastic material 28 is vulcanized to the rear or trailing edge of the vertical portion 10. The pad 26 has a central, raised portion 30 typically having a thickness of about two inches. On either side of the raised portion 30 are tapered portions 32 and 34 which slope downwardly from the central portion 30 to the forward surface or face of the vertical portion 10. The rear pad 28 is of a substantially constant thickness (typically one-half inch) along most of its length but is tapered at its opposite ends 36 and 38.

The tapered design is important because it eliminates damage to the top edge of the coil whenever the coil is set on the floor and the load is taken off the hook. Typically, "C" hook tilts inwardly when relieved of the weight of the coil. If the urethane were a straight piece, it would jam against the top edge of the coil. In the present invention, the tapered design assures that the urethane only touches the portion of the side wall of the coil in the event the hook tilts inwardly.

Vulcanized to the bottom, front, and sides of the counterweight 22 are pads 40 of semi-rigid plastic material. This prevents damage to the side of a coil of steel strip material, for example, should the counterweight slam into the coil.

Figure 2A:
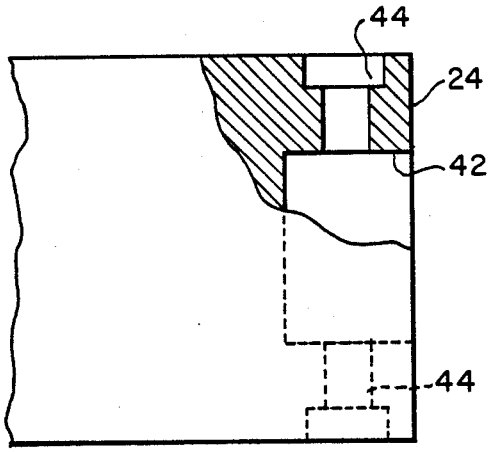
FIGS. 2A, 2B, and 2C are top, side, and front views, respectively, of the forward end of the lower horizontal leg of the hook shown in FIG. 1, illustrating a manner in which a receptacle is machined into the forward end to receive a plug of shock-absorbing material.
Figure 2B:
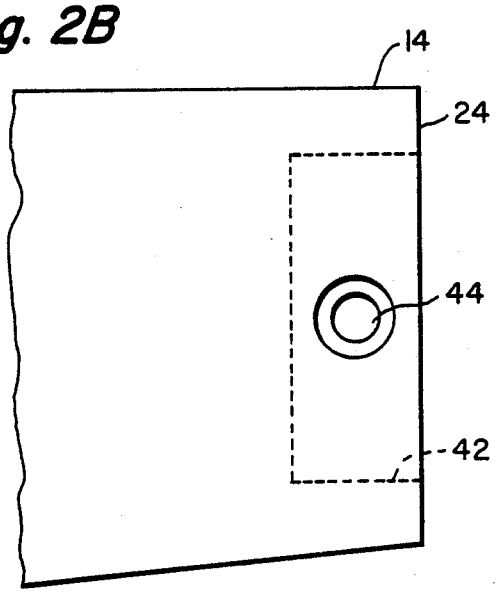
Figure 2C:
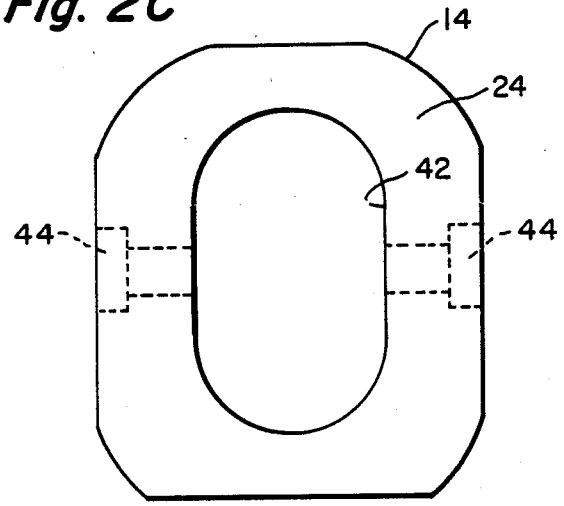

With reference to FIGS. 2A–2C, the forward end 24 of the lower leg 14 is machined to provide a receptacle 42. As shown in FIG. 2C, the receptacle 42 has straight side walls but rounded end walls at its top and bottom. Drilled into the sides of the lower leg 14, on opposite sides of the receptacle, are countersunk holes 44 which receive hex-head bolts 46 (see FIG. 1).

Figure 3A:
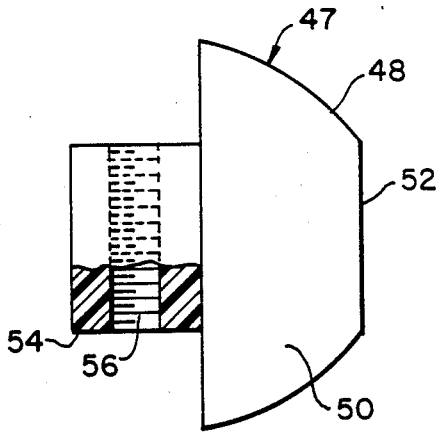
FIGS. 3A, 3B, and 3C are top, side, and front views of the replaceable nose insert which is insertable into the receptacle shown in FIGS. 2A–2C.
Figure 3B:
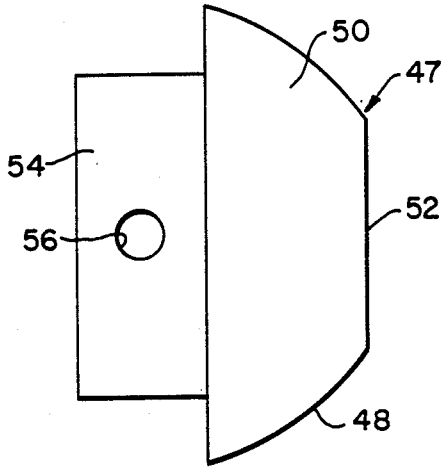
Figure 3C:
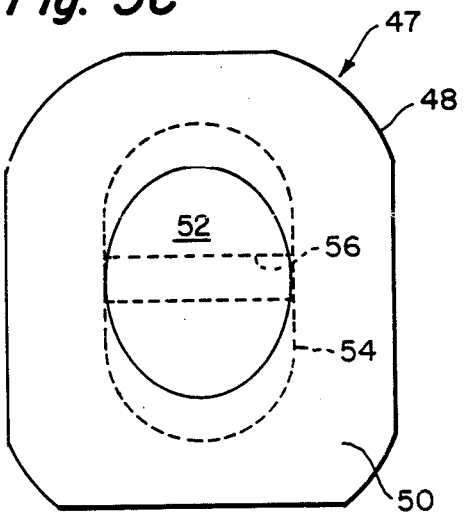

Received within the receptacle 42 at the forward end 24 of leg 14 is a replaceable insert 47 shown in FIGS. 3A–3C. It is formed from the same semi-rigid plastic material as are elements 26, 28, and 40 shown in FIG. 1 and already described. Insert 47 has a forward nose portion 48 with tapered, rounded surfaces 50 at its top, bottom, and sides. These tapered surfaces extend from the upper and lower edges of leg 14 to a flat, forward portion 52.

Projecting backwardly from the nose portion 48 is a projection 54 provided with a threaded, central opening 56 which receives the shank portion of the hex-head bolt 46. To remove a worn insert from the forward end of the lower leg 14 it is necessary only to unthread the hex-head bolt 46, pull the worn nose insert from the receptacle 42 and then insert the projection 54 of a new nose insert into the receptacle 42, whereupon the hex-head bolts 46 are again threaded into the opening 56.

The urethane may be used as the cushioning material and is preferably SCOTHANE TM 70 durometer molded urethane.

Although the invention has been shown in connection with a certain specific embodiment, it will be readily apparent to those skilled in the art that various changes in form and arrangement of parts may made to suit requirements without departing from the spirit and scope of the invention.

We claim as our invention:

1. A protective system for a crane "C" hook to prevent impact damage to coiled strip material lifted by the "C" hook, said protective system comprising:

a receptacle formed in a substantially vertical face at a forward end of a lower horizontal leg of the "C" hook, said receptacle extending substantially horizontally and rearwardly into said forward end; and a plug of shock absorbing material removably insertable into said receptacle, said plug having a first portion and a second portion, said first portion being receivable in said receptacle, said second portion protruding from said forward end when said first portion is received in said receptacle, said second portion having a rearward face and a forward face, said rearward face conforming substantially in size and shape to the size and shape of said vertical face, said second portion tapering in size from said rearward face to said forward face, whereby the construction of said plug of shock absorbing material is such that an upper load carrying surface of the lower horizontal leg of the "C" hook is devoid of any covering by said shock absorbing material when said plug is inserted into said receptacle and wherein if the forward end of said lower horizontal leg engages a side of a coil, the shock absorbing material will prevent damage to the coil.

2. The protective system of claim 1 including shock absorbing material secured to at least an inner face of a vertical leg of said "C" hook.

3. The protective system of claim 1 wherein shock absorbing material is secured to both inner and outer faces of a vertical leg of the "C" hook.

4. The protective system of claim 3 wherein the shock absorbing material comprises a semi-rigid plastic.

5. The protective system of claim 3 wherein the shock absorbing material comprises molded urethane.

6. The protective system of claim 1 further comprising means for retaining said plug in said receptacle.

7. The protective system of claim 6 wherein said means for retaining comprise threaded fastener means threadably connectable to said first portion.

8. A protective system for a crane "C" hook to prevent impact damage to coiled strip material lifted by the "C" hook, said protective system comprising:

shock absorbing material secured to both inner and outer faces of a vertical leg of said "C" hook, a receptacle formed in a substantially vertical face at a forward end of a lower horizontal leg of the "C" hook, said receptacle extending substantially horizontally and rearwardly into said forward end;

a plug of shock absorbing material removably insertable into said receptacle, said plug having a first portion and a second portion, said first portion being receivable in said receptacle, said second portion protruding from said forward end when said first portion is received in said receptacle, said second portion having a rearward face and a forward face, said rearward face conforming substantially in size and shape to the size and shape of said vertical face, said second portion tapering in size from said rearward face to said forward face, whereby the construction of said plug of shock absorbing material is such that an upper load carrying surface of the lower horizontal leg of the "C" hook is devoid of any covering by said shock absorbing material when said plug is inserted into said receptacle and wherein if the forward end of said lower horizontal leg engages a side of a coil, the shock absorbing material will prevent damage to the coil;

a counterweight secured to an outer end of an upper horizontal leg of said "C" hook; and shock absorbing material secured to the forward, side and lower surfaces of said counterweight to prevent damage to the side of said coil of strip material should the counterweight engage said side.

9. The protective system of claim 8 wherein said shock absorbing material comprises molded urethane and wherein the shock absorbing material secured to the inner face of the vertical leg of the hook has a raised central portion bounded by tapered portions which extend from the raised portion to the inner face of said vertical leg.

10. The protective system of claim 9 wherein the shock absorbing material is vulcanized to the inner and outer faces of the vertical leg of the "C" hook and to the forward, side and lower surfaces of the counterweight.

* * * * *